US005288244A

United States Patent [19]

Lien

[11] Patent Number: 5,288,244

[45] Date of Patent: Feb. 22, 1994

[54] CONNECTOR ASSEMBLY HAVING FIXED UNITARY FASTENERS FOR MOUNTING TO A PANEL

[75] Inventor: Teh-Sou Lien, Taipei, Taiwan

[73] Assignee: Maxconn Incorporated, San Jose, Calif.

[21] Appl. No.: 49,141

[22] Filed: Apr. 19, 1993

[51] Int. Cl.[5] ..... H01R 4/18; H01R 13/621

[52] U.S. Cl. ..... 439/362; 439/564; 439/607; 29/838; 29/509; 29/525.1; 411/183

[58] Field of Search ..... 439/560, 564, 573, 84, 439/566, 607, 870, 562, 362, 557; 411/173, 177, 113, 181, 183; 29/838, 505, 509, 525.1

[56] References Cited

U.S. PATENT DOCUMENTS

| | | | |
|---|---|---|---|
| 2,985,213 | 5/1961 | Consandine | 411/183 |
| 4,709,973 | 12/1987 | Waters et al. | 439/78 |
| 4,755,153 | 7/1988 | Limanowski et al. | 439/870 |
| 4,878,856 | 11/1989 | Maxwell | 439/540 |
| 4,911,659 | 3/1990 | Viselli | 439/570 |
| 4,966,512 | 10/1909 | Takaku | 411/181 |
| 5,006,025 | 4/1991 | Duran | 411/183 |
| 5,044,975 | 9/1991 | DiBene, II et al. | 439/352 |
| 5,065,283 | 11/1991 | Adachi et al. | 439/84 |
| 5,066,246 | 11/1991 | Jensik | 439/562 |
| 5,088,935 | 2/1992 | Dise et al. | 439/573 |

FOREIGN PATENT DOCUMENTS

| | | | |
|---|---|---|---|
| 512124 | 8/1939 | United Kingdom | 439/870 |

*Primary Examiner*—Gary F. Paumen
*Attorney, Agent, or Firm*—Schneck & McHugh

[57] ABSTRACT

An electrical connector assembly and method includes a connector body and at least one unitary fastening member that is deformed at a central region of the fastening member after insertion through a mounting hole in the connector body. Projecting integrally from the deformed region of the fastening member is an internally threaded post which may receive cable screws of a cable mated with the connector assembly. In a preferred embodiment, the fastening member secures a ground strap and a faceplate to the connector body, and the internally threaded post is inserted through a panel of a computer system component.

18 Claims, 2 Drawing Sheets

CONNECTOR ASSEMBLY HAVING FIXED UNITARY FASTENERS FOR MOUNTING TO A PANEL

DESCRIPTION

1. Technical Field

The present invention relates generally to electrical connectors and more particularly to connectors to be mounted to a panel or the like.

2. Background Art

Connectors for electrically linking components of a computer system or a scientific instrument or the like are well known. Frequently, connectors are mounted to rear panels of a system component, such as a computer itself, to couple with a cable connector from another system component. U.S. Pat. No. 4,878,856 to Maxwell describes a stacked connector that may be mounted to such a rear panel.

The conventional method of securing a connector to a panel is to insert jack screws through holes in the panel for threaded attachment to the connector. The jack screws are externally threaded at one end for attachment to the connector and are internally threaded at the opposite end to receive cable connector screws. In addition to the jack screws, other loose hardware for mounting the connector to the panel includes lock washers. The lock washers reduce the susceptibility of the mounting assembly to unintentional unfastening.

The conventional mounting method requires a manufacturer of a computer system component to either make or order the connectors and the loose hardware. If the connector is ordered, typically the vendor is responsible for the supply and packaging of the loose hardware.

Moreover, the manufacturer of the computer system must install the jack screws and lock washers. This adds to the cost of manufacture.

Attempts have been made to eliminate the abovedescribed labor intensive mounting arrangement. U.S. Pat. Nos. 4,911,659 to Viselli and 4,709,973 to Waters et al. describe inserts that are friction fit into apertures of D-type connectors. Ribs secure the inserts within the apertures. The apertures include projections that cooperate with the ribs to provide a firmer fit. Waters et al. describes an extended portion that can be inserted through a panel and secured by a screw bolt, and a second D-type connector can thereafter be fitted over the same. While these patents provide an improvement over the conventional mounting method, further improvement is possible.

It is an object of the present invention to provide an electrical connector assembly and a method of forming the assembly, wherein mounting to a panel or the like can be performed in a minimal time without the need of tools.

SUMMARY OF THE INVENTION

The above object has been met by an assembly and method that eliminate loose hardware from the mounting of a connector to a panel and to a second connector. Unitary fastening members are inserted through mounting holes in a connector body such that each fastening member has an internally threaded post that projects outwardly from a face of the connector body. A central segment of each fastening member is in effect peeled backward to contact the face surface of the connector body.

In a preferred embodiment, the connector body is a D-type connector having an array of contact elements. First ends of the contact elements are fixed to a printed circuit board or the like, while second ends are secured for mating with contact elements of a second connector.

In assembly, the unitary fastening members are inserted through a mounting hole in a direction generally parallel to the second ends of the contact elements. A metallic faceplate having holes aligned with the mounting holes of the connector body is placed against the face surface of the connector body. The unitary fastening members have a flange at an end opposite to the internally threaded post end. The flange prevents the fastening member from passing entirely through the mounting hole of the connector body. The fastening member has a shoulder extending from the flange to a region slightly beyond the faceplate. It is the portion of the shoulder extending beyond the faceplate that is deformed by a compression force in order to secure the faceplate and the fastening member to the connector body. The use of the faceplate, however, is not critical.

Preferably a ground strap is utilized to mechanically and electrically couple the connector assembly to the printed circuit board. The ground strap is fixed to the connector body by sandwiching a portion of the ground strap between the flange of the unitary fastening member and the rear surface of the connector body.

In securing the connector assembly to a panel, the rigid attachment of the assembly to the printed circuit board provides sufficient mechanical strength to properly position the assembly during attachment and detachment of a mating cable or the like. In attaching the connector assembly to a mating cable, the projecting internally threaded post of each fastening member is positioned to receive conventional cable screws.

An advantage of the present invention is that a one-piece fasteners act to secure the various members of the assembly to a connector body. The one-piece fasteners also serve the function of attaching the assembly to a mating cable. Thus, the number of necessary parts is reduced as compared to conventional attachment methods using jack screws. Moreover, as compared to the use of jack screws, the present invention is less susceptible to accidental unfastening that may result from vibrations.

BEST MODE FOR CARRYING OUT THE INVENTION

Figure 1:
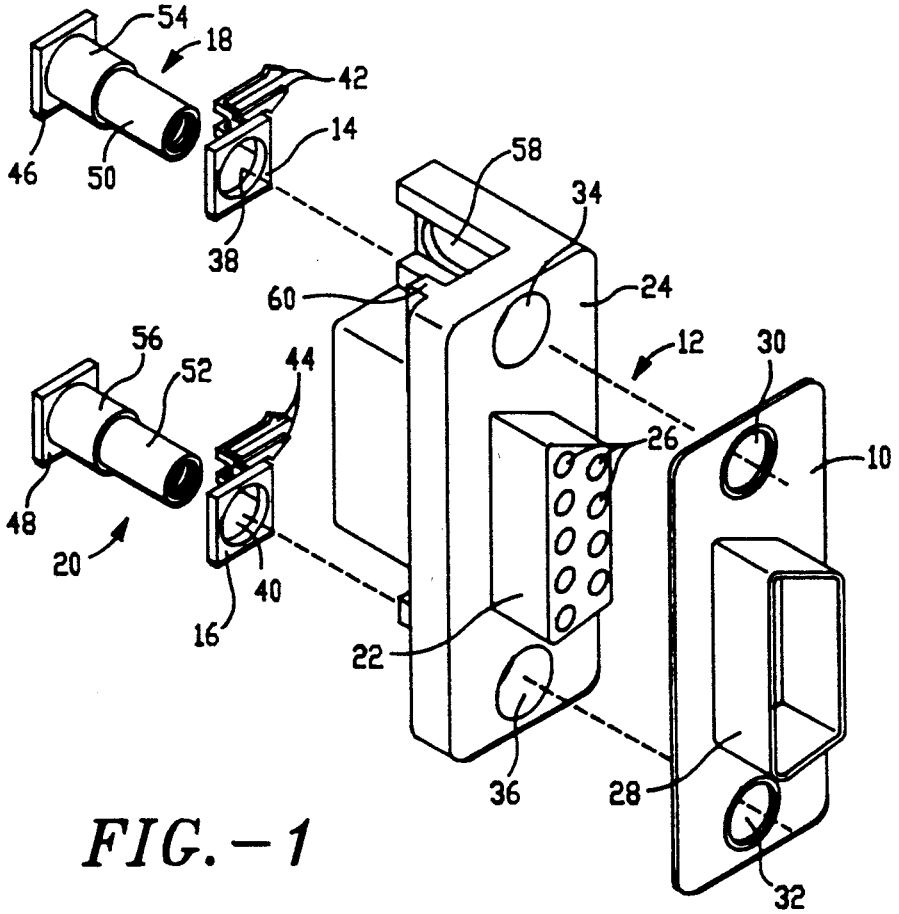
FIG. 1 is an exploded view of an electrical connector assembly in accordance with the present invention.

With reference to FIG. 1, an electrical connector assembly includes a faceplate 10, a connector body 12, a pair of ground straps 14 and 16, and a pair of unitary fastening members 18 and 20. The connector body 12 is a sub-miniature connector that is commonly referred to as a D-type connector, but this is not critical. The connector body includes a D-shaped cable mating portion 22 projecting outwardly from a front surface 24. While not shown, the connector body includes right angle contact elements having first ends that extend from a base of the connector body for insertion into throughholes of a printed circuit board or the like. Second ends of the contact elements are aligned with pin-receiving holes 26 in the mating portion 22, so as to permit pins from a cable to electrically couple to the contact elements of the connector body.

The faceplate 10 is a metallic member that slides into position against the front surface 24 of the connector body 12. The faceplate is made of a sturdy material, such as steel having a coating of zinc or lead. The connector body is made of a dielectric material.

The geometry of the faceplate 10 corresponds to that of the front surface 24 of the connector body 12. The faceplate includes a D-shaped frame 28 that receives the mating portion 22 of the connector body. Faceplate holes 30 and 32 are aligned with mounting holes 34 and 36 in the connector body.

The ground straps 14 and 16 each include an eyelet 38 and 40 and a pair of tangs 42 and 44. The tangs are only slightly elastic and are flared at a lower extremity. The length of the tangs corresponds to the standard depth of a printed circuit board, so that the tangs can be inserted into holes of a printed circuit board to maintain the connector assembly in a fixed position during soldering of the contact elements to the printed circuit board. As will be clear below, the ground straps can be used to establish a ground connection from the printed circuit board to the faceplate 10.

The fastening members 18 and 20 are metallic members which have square flanges 46 and 48 at back ends and internally threaded cylindrical posts 50 and 52 at ends opposite to the flanges. Shoulders 54 and 56 integrally extend from the flanges.

The fastening members 18 and 20 of FIG. 1 have a length of 10.5 mm. The portion of the fastening members comprising the cylindrical posts 50 and 52 is 5.5 mm in depth, while the shoulders are 4.0 mm. The length of the shoulders is such that when the fastening members pass through the ground straps 14 and 16, the connector body 12 and the faceplate 10, the shoulders extend slightly beyond the faceplate.

Figure 2:
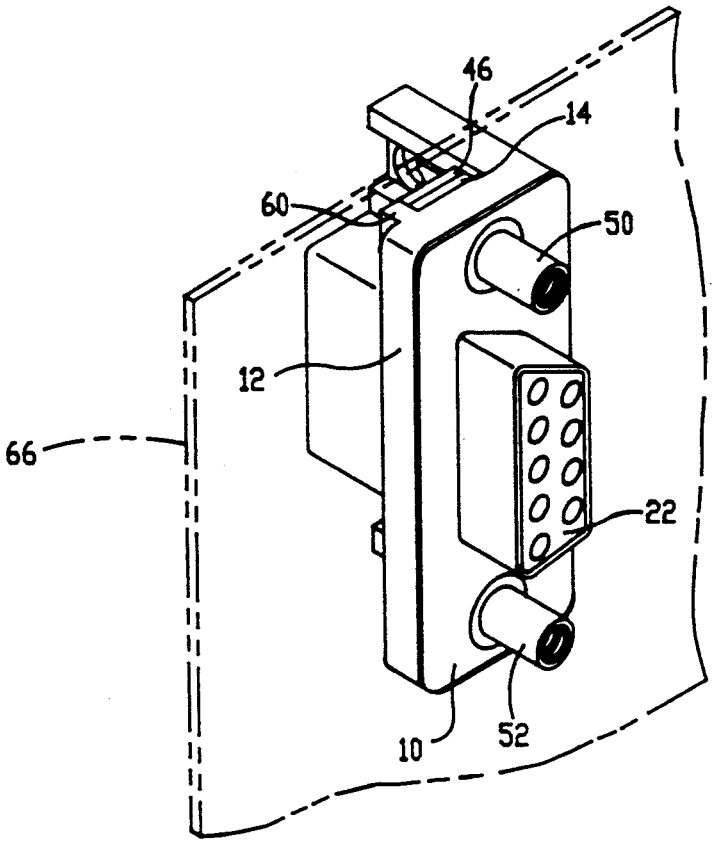
FIG. 2 is a perspective view of the connector assembly of FIG. 1 shown mounted to a panel.
Figure 3:
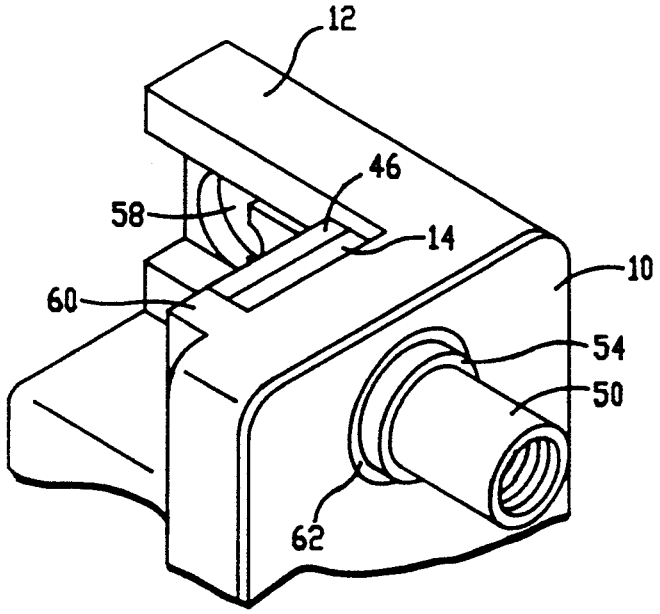
FIG. 3 is a partial perspective view of the connector assembly of FIG. 1 prior to deforming a fastening member.

In assembly, the tangs 42 and 44 of the ground straps 14 and 16 are inserted through apertures 58 in the base of the connector body 12. The eyelets 38 and 40 of the ground straps are aligned with the mounting holes 34 and 36 of the connector body and the faceplate holes 30 and 32. As seen in FIGS. 2 and 3, the ground straps abut the back surface of the connector body and the configuration of the ground straps and the flanges 46 and 48 on the fastening members 18 and 20 provides a means for preventing rotation of the ground straps and the fastening members. Surfaces of the ground straps and the flanges contact a lateral surface of a projection 60 extending from the back surface of the connector body.

As shown in FIG. 3, the shoulder 54 extends beyond the face surface of the faceplate 10. While not critical, the faceplate 10 may have a recess 62 surrounding the rim of the faceplate hole through which the shoulder 54 passes. Thus, the faceplate hole has a diameter slightly greater than that of the shoulder 54, while the recess 62 extends yet further in diameter.

Figure 4:
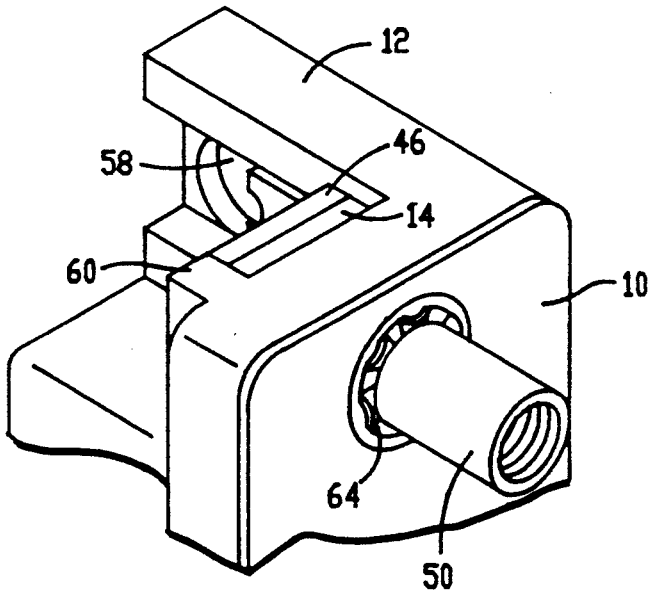
FIG. 4 is a partial perspective view of the connector assembly of FIG. 3 following deforming of the fastening member.

The recess 62 in the faceplate 10 provides an area for the flow of material when the shoulder 54 is deformed to securely fix the fastening member, the ground strap 14 and the faceplate 10 to the connector body 12. Tooling is used to compress the portion of the shoulder 54 that extends beyond the recess 62. For example, the tooling may include a punch member having a recess dimensioned to receive the cylindrical post 50 but not the shoulder 54 of the fastening member. A second member of the tooling may be used to provide support at the rear of the flange 46. A compression force on the punch will then, in effect, peel back the top portion of the shoulder, causing material to flow into the recess 62. Preferably, the punch includes cutting ridges to reliably define the dimensions of the flow into the recess. As shown in FIG. 4, a deformed portion of the fastening member acts with the flange 46 of the fastening member to press the faceplate 10 and the ground strap 14 against the connector body 12.

As noted above, the connector body 12 includes contact elements that extend from the base of the connector body for insertion into throughholes of a printed circuit board. The printed circuit board may then be installed in a component of a computer system, such as the computer itself, with the electrical connector assembly aligned with the panel of the system component. The present invention utilizes the rigid attachment of the printed circuit board to the system component to firmly lock the electrical connector assembly in a desired position relative to the component panel. Returning to FIG. 2, the mating portion 22 and the cylindrical posts 50 and 52 of the electrical connector assembly extend through openings in a component panel 66. No loose hardware is necessary to mount the connector assembly to the component panel. A cable and its connector, not shown, can then be brought into contact with the connector assembly, with cable connector screws being threaded into the cylindrical posts 50 and 52 to lock the cable to the connector assembly.

While the present invention has been described and illustrated as being used with D-type connectors that are attached to printed circuit boards, other connector types and other attachment devices may be utilized with the fastening members.

We claim:

1. An electrical connector assembly comprising, a connector body having a face surface and a rear surface and having an array of contact elements, said connector body having a mounting hole extending to said face surface, and a unitary fastening member passing through said mounting hole, said unitary fastening member having an expanded portion at said rear surface of said connector body and having a deformed portion at said face surface, said unitary fastening member having an internally threaded section projecting outwardly beyond said deformed portion for coupling to an externally threaded fastener of a second connector, said expanded portion and said deformed portion each being larger than said mounting hole so that said unitary fastening member is fixed to said connector body.

2. The assembly of claim 1 wherein said unitary fastening member is a metallic fastener having an exterior shoulder, said deformed portion being a compressed region of said shoulder.

3. The assembly of claim 1 wherein said expanded portion of said unitary fastening member has a configuration to restrict rotation of said unitary fastening member.

4. The assembly of claim 1 wherein said connector body is a D-type connector.

5. The assembly of claim 1 wherein said deformed portion abuts said face surface of said connector body.

6. The assembly of claim 1 wherein said internally threaded section of said unitary fastening member is cylindrical.

7. An electrical connector assembly comprising, a dielectric connector body having a front surface and a rear surface and having a plurality of conductive contacts, said connector body having a mounting hole extending from said front surface to said rear surface, a faceplate coupled to said front surface of said connector body, and a single-piece fastener extending through said faceplate and said mounting hole, said fastener having a first end at said rear surface of said connector body, said first end having a flange to prevent entry into said mounting hole, said fastener having an external shoulder, a portion of said external shoulder being compressed to abut said faceplate, thereby securing said faceplate and said fastener to said connector body, said fastener having an internally threaded post integrally extending outwardly from said compressed portion.

8. The assembly of claim 7 wherein said connector body has a second mounting hole on a side of said conductive contacts opposite to said fastener, said assembly further comprising a second fastener extending through said second mounting hole, said second fastener and said fastener being substantially identical.

9. The assembly of claim 8 wherein said connector body is a D-type connector.

10. The assembly of claim 7 wherein said fastener is metallic.

11. The assembly of claim 7 wherein said shoulder extends through said mounting hole.

12. The assembly of claim 7 further comprising a ground strap having a segment sandwiched between said rear surface of said connector body and said first end of said fastener.

13. A method of forming an electrical connector assembly for mounting in a panel comprising, providing a connector body having mounting holes on opposed sides of an array of contact elements, inserting unitary fasteners through said mounting holes such that a first end of each unitary fastener is prevented from entering the respective mounting hole and a second internally threaded end projects outwardly from said mounting hole, and deforming an intermediate region of each unitary fastener such that said deformed intermediate region combines with said first end to sandwich said connector body therebetween, thereby securing said unitary fasteners to said connector body in a position in which said second internally threaded ends project outwardly from a panel for receiving externally threaded fastening members.

14. The method of claim 13 further comprising inserting said second internally threaded ends of said unitary fasteners through holes in said panel.

15. The method of claim 13 further comprising fitting a faceplate to said connector body prior to said deforming said intermediate portions of said unitary fasteners, said deforming thereafter pressing said deformed intermediate regions onto said faceplate.

16. The method of claim 13 wherein said providing a connector body is a step of providing a D-type connector.

17. The method of claim 13 further comprising locating ground straps against said connector body such that said ground straps are fixed between said connector body and said first ends of said unitary fasteners.

18. The method of claim 13 wherein said deforming includes compressing a shoulder region of each unitary fastener, thereby expanding the width of said unitary fasteners so as to secure said unitary fasteners to said connector body.

* * * * *